US006352217B1

(12) United States Patent
Hsu et al.

(10) Patent No.: US 6,352,217 B1
(45) Date of Patent: Mar. 5, 2002

(54) MISSILE FIN LOCKING AND UNLOCKING MECHANISM INCLUDING A MECHANICAL FORCE AMPLIFIER

(75) Inventors: William W. Hsu, Glendale; Matthew Miotla, Valencia, both of CA (US)

(73) Assignee: HR Textron, Inc., Valencia, CA (US)

( * ) Notice: Subject to any disclaimer, the term of this patent is extended or adjusted under 35 U.S.C. 154(b) by 0 days.

(21) Appl. No.: 09/556,807

(22) Filed: Apr. 25, 2000

(51) Int. Cl.[7] ..... F42B 10/06
(52) U.S. Cl. ..... 244/3.24; 244/3.21; 244/49
(58) Field of Search ..... 244/3.21, 3.24–3.3, 244/49

(56) References Cited

U.S. PATENT DOCUMENTS

| | | | | |
|---|---|---|---|---|
| 2,852,210 A | | 9/1958 | Dietrich | |
| 3,045,779 A | | 7/1962 | Rosenthal | |
| 3,093,075 A | | 6/1963 | Garrett et al. | |
| 3,182,564 A | | 5/1965 | Sobeck et al. | |
| 3,578,783 A | | 5/1971 | Loustalet et al. | |
| 3,711,040 A | | 1/1973 | Carver | 244/3.21 |
| 3,759,466 A | | 9/1973 | Evers-Euterneck | 244/3.21 |
| 4,173,322 A | | 11/1979 | Macdonald | 244/75 |
| 4,175,720 A | * | 11/1979 | Craig | 244/3.28 |
| 4,603,594 A | | 8/1986 | Grimm | 74/89.15 |
| 4,667,899 A | * | 5/1987 | Wedertz | 244/3.24 |
| 4,691,880 A | | 9/1987 | Frank | 244/49 |
| 4,728,058 A | | 3/1988 | Brieseck et al. | 244/3.28 |
| 4,795,110 A | | 1/1989 | Lang | 244/3.24 |
| 4,860,969 A | | 8/1989 | Muller et al. | 244/3.27 |
| 5,114,095 A | * | 5/1992 | Schroppel et al. | 244/3.28 |
| 5,409,185 A | | 4/1995 | Oldakowski | 244/75 |
| 5,950,963 A | * | 9/1999 | Speecher et al. | 244/3.21 |
| 6,224,013 B1 | * | 5/2001 | Chisolm | 244/3.27 |
| 6,250,584 B1 | * | 6/2001 | Hsu et al. | 244/3.24 |

FOREIGN PATENT DOCUMENTS

| | | |
|---|---|---|
| GB | 560931 | 4/1944 |
| GB | 2237362 A | 1/1991 |

* cited by examiner

*Primary Examiner*—Harold J. Tudor
(74) *Attorney, Agent, or Firm*—Fulbright & Jaworski L.L.P.

(57) ABSTRACT

A locking and unlocking mechanism for moveable control fins extending from the surface of a missile. The locking mechanism includes a pin extending thru the outer surface of the missile into an opening provided in the movable fin. A link is pivotally connected between each of the pins and a slide member disposed internally of the missile and carried by a guide. The links are in a close to dead center position when the pins are extended into the openings in each of the fins. A striker assembly is disposed within the slide member and includes a rod carrying a hammer which is spring loaded spaced from the slide member when the pins are in their extend position. Upon a command signal from a controller, preparatory to missile launch, a restraining device holding the striker is removed and the spring propels the striker into engagement with a force sufficient to move the links past their dead center position upon which additional springs which are loaded around each of the pins are activated to positively move the slide and retract the pins from the openings in the fins.

7 Claims, 4 Drawing Sheets

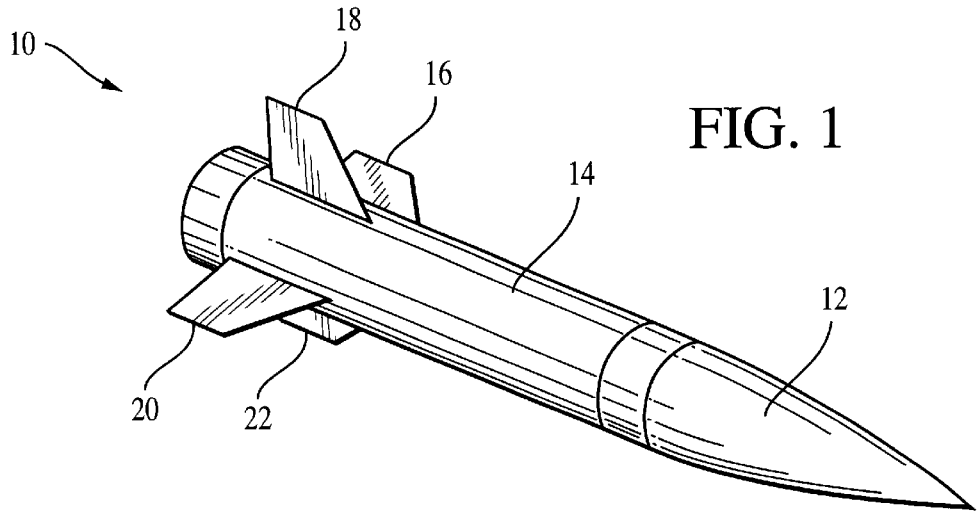
FIG. 1
FIG. 2
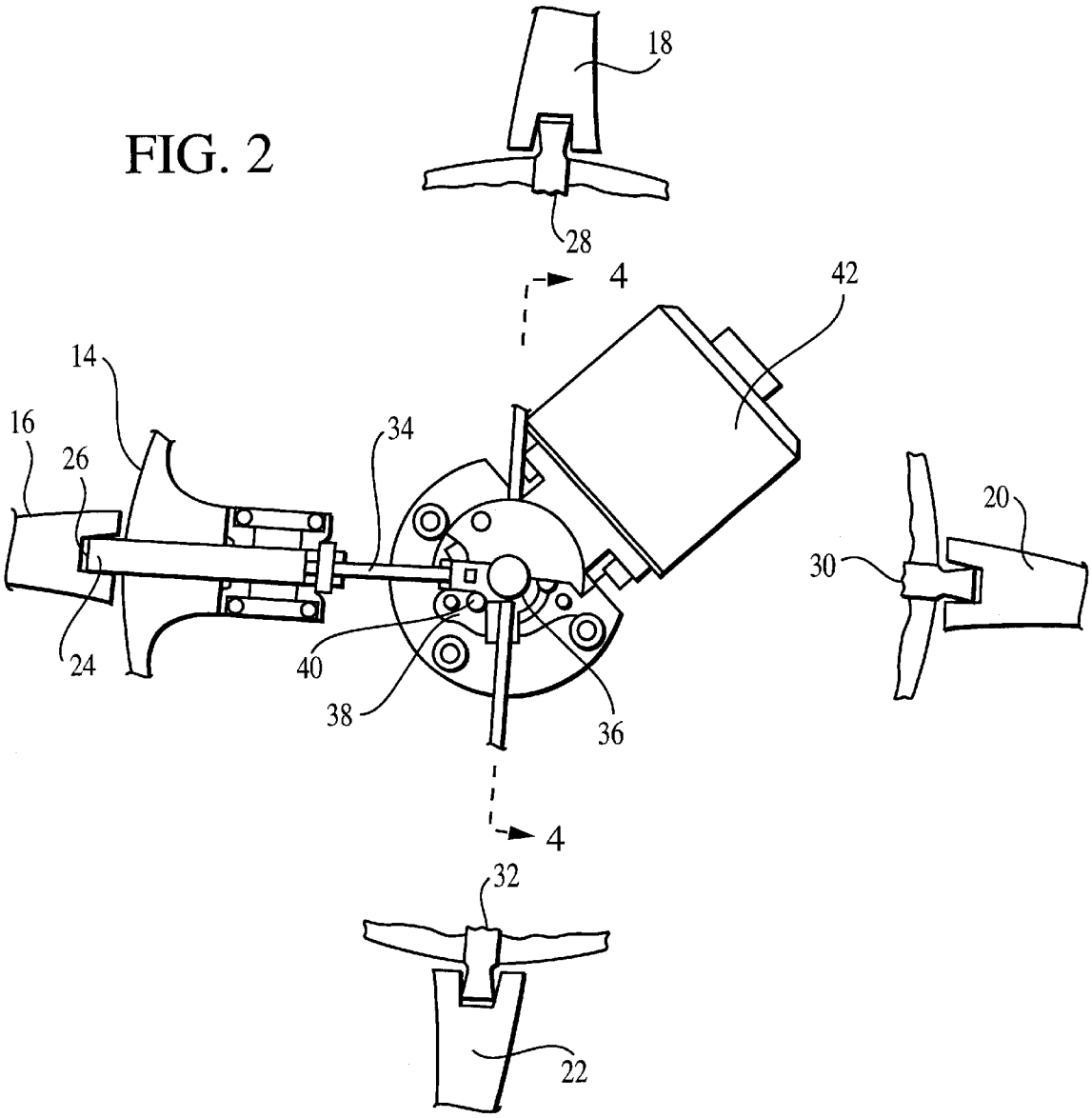

MISSILE FIN LOCKING AND UNLOCKING MECHANISM INCLUDING A MECHANICAL FORCE AMPLIFIER

FIELD OF THE INVENTION

The present invention relates to moveable control fins for missiles carried on aircraft and more particularly to a system for locking the fin against aerodynamic loads and preventing the transmission of these loads through the drive train and upon receipt of a command signal activating a mechanical assembly which includes a force amplifier to ensure that the fin locking system is deactivated.

DESCRIPTION OF THE PRIOR ART

Flight control systems of many diverse types have been widely utilized. They generally include a control surface and in the case of a missile the control surface is typically a fin. Generally the control surface or fin is connected by a shaft adapted to be moveable for purposes of flight control. The fin shaft is generally connected through an output drive shaft that is rotated by connection through an appropriate drive train to a power source.

During flight before launch when the missile is positioned on the exterior of the aircraft the fin is subjected to high aerodynamic loading. This loading causes the fin to move in the direction of the load and in turn causes the fin shaft to rotate which rotation is transmitted through the drive train causing flutter and fatigue failures. Such is the case even when a brake mechanism is utilized in an attempt to stop the flutter rotation of the fin shaft or the output shaft.

As a result of this undesirable aerodynamic loading of the drive train, various attempts have been made to provide a lock which would eliminate the effect of aerodynamic loading. Examples of such locks designed particularly for utilization upon missiles or projectiles utilizing control fins are shown in U.S. Pat. Nos. 4,759;110; 5,409,185 and 5,505,408 and British Specification 560,931 accepted Apr. 27, 1944. Unfortunately, most locks for control surfaces such as fins on missiles have failed in numerous respects. For instance, some of the locks have been prone to sticking or otherwise failing to release upon command in a substantially frictionless fashion. Some locks have been prone to inadvertent unlatching due to vibration during normal operation. Other locking mechanisms are quite complex and include a large number of parts all of which must operate properly to avoid a malfunction. One system which overcomes many of the problems in the prior art is disclosed in application Ser. No. 09/419,544 filed Oct. 18, 1999 for Missile Fin Locking Mechanism, now U.S. Pat. No. 6,250,584, which is assigned to the assignee of the present application and is incorporated herein by reference. However, even that system from time to time experienced difficulty in retracting the locking pin from the fin immediately upon command.

SUMMARY OF THE INVENTION

The present invention is directed to a locking mechanism for use on a missile having a plurality of moveable control fins extending from an outer surface thereof, the locking mechanism includes a locking pin for each of the moveable control fins which is adapted to extend through the outer surface of the missile into an opening in the control fin to retain the control fin in a fixed position prior to launch is provided. A slide member which is moveable between a pin extend and a pin extract position with a plurality of links one coupling each of the pins to the slide member. When the slide member is in its pin extend position each of the links is positioned in a substantially dead center position. Means including a movable mass is provided for forcefully contacting the slide to initiate movement of the slide member away from its pin extend position. Spring means is provided at each locking pin for positively moving the slide member from its pin extend position to its pin retract position to remove each of the pins from the opening in its respective moveable control fin subsequently to contact of the movable mass with the slide member.

BRIEF DESCRIPTION OF THE DRAWINGS

FIG. 1 is a schematic representation of a missile which may utilize a locking and unlocking mechanism for its control fins constructed in accordance with the principles of the present invention;

FIG. 2 is a rear view in partial cross-section of a locking mechanism construed in accordance with the present invention shown in its locked position;

DETAILED DESCRIPTION OF THE INVENTION

Shown generally at (10) in FIG. 1 is a missile (12) which may be carried by appropriate fittings (not shown) underneath the wing of an aircraft for ultimate launching at a target. Attached to an outer surface (14) of the missile is a plurality of fins (16–22) which as illustrated are disposed 90° apart around the circumference of the missile. Although four such control fins are shown in this particular drawing it should be understood that a lesser or greater number may be utilized depending upon the particular missile and its intended missions. All or some of the fins (16–22) may be moveable for purposes of controlling the direction of flight both in yaw and pitch in accordance with a guidance mechanism included within the missile. For example, one such guidance mechanism may utilize Global Positioning System (GPS) signals as is well known to direct the missile to a desired target which has been preprogramed into the guidance system of the missile. Thus, after launch the GPS signals are utilized to provide motion to an appropriate drive mechanism which is connected by a drive train to a shaft upon which the fins (16–22) are mounted to effect movement of one or more of the fins to thus control the flight path of the missile.

As above referred to, while the missile (12) is affixed to the exterior to the aircraft and before launch, the fins (16–20) are subjected to aerodynamic loads as the aircraft carrying the missile moves through the atmosphere. These aerodynamic loads can cause movement to the fins damaging them and thus causing them to improperly direct the flight path of the missile (12) after launch or alternatively may apply such loads to the drive train deleteriously affecting it and cause failure of the missile as a result of fatigue, strain or failure of the drive train through application of the aerodynamic loads.

Figure 3:
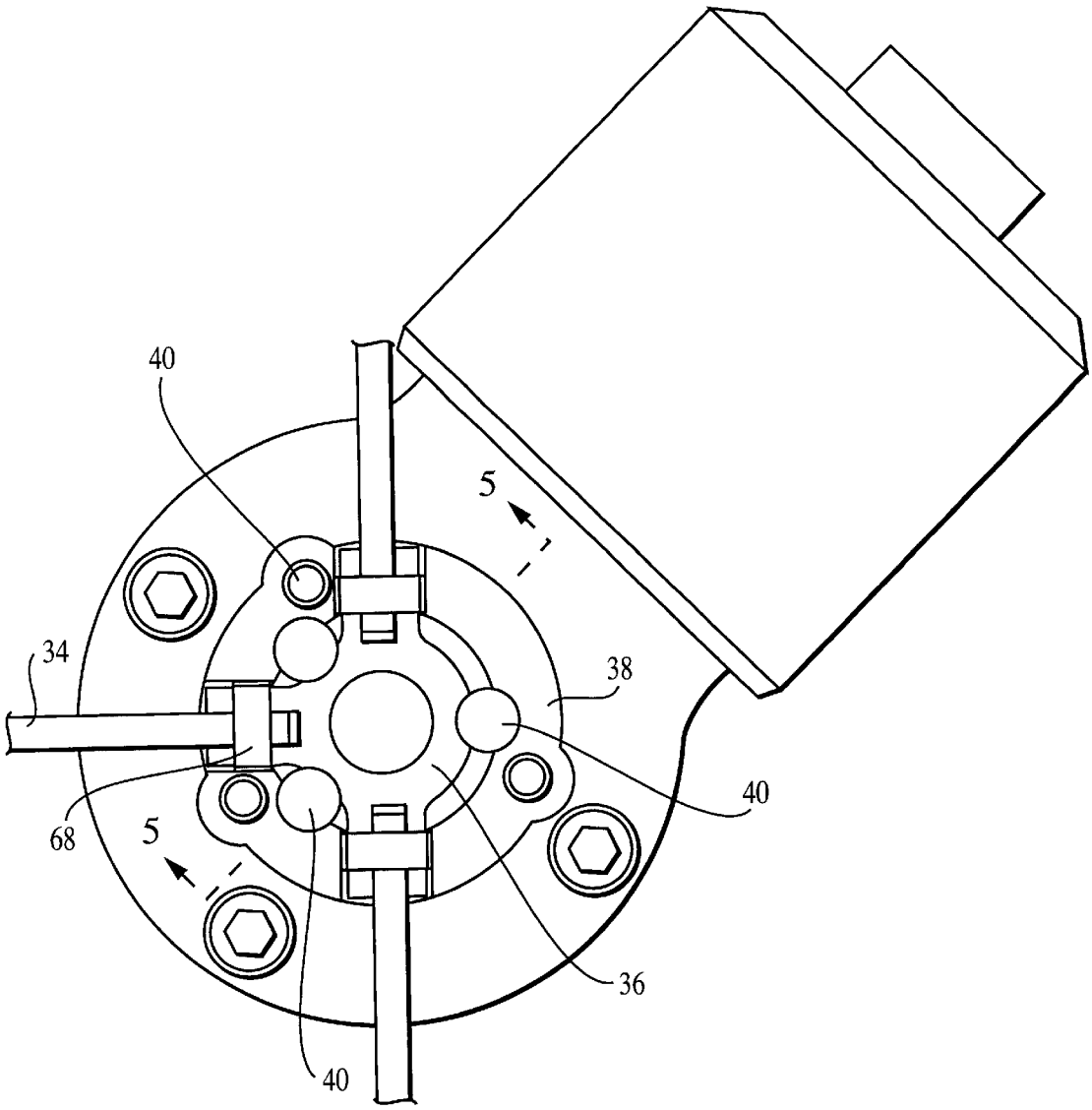
FIG. 3 is a view similar to FIG. 2 without the pins and with the cover removed.
Figure 4:
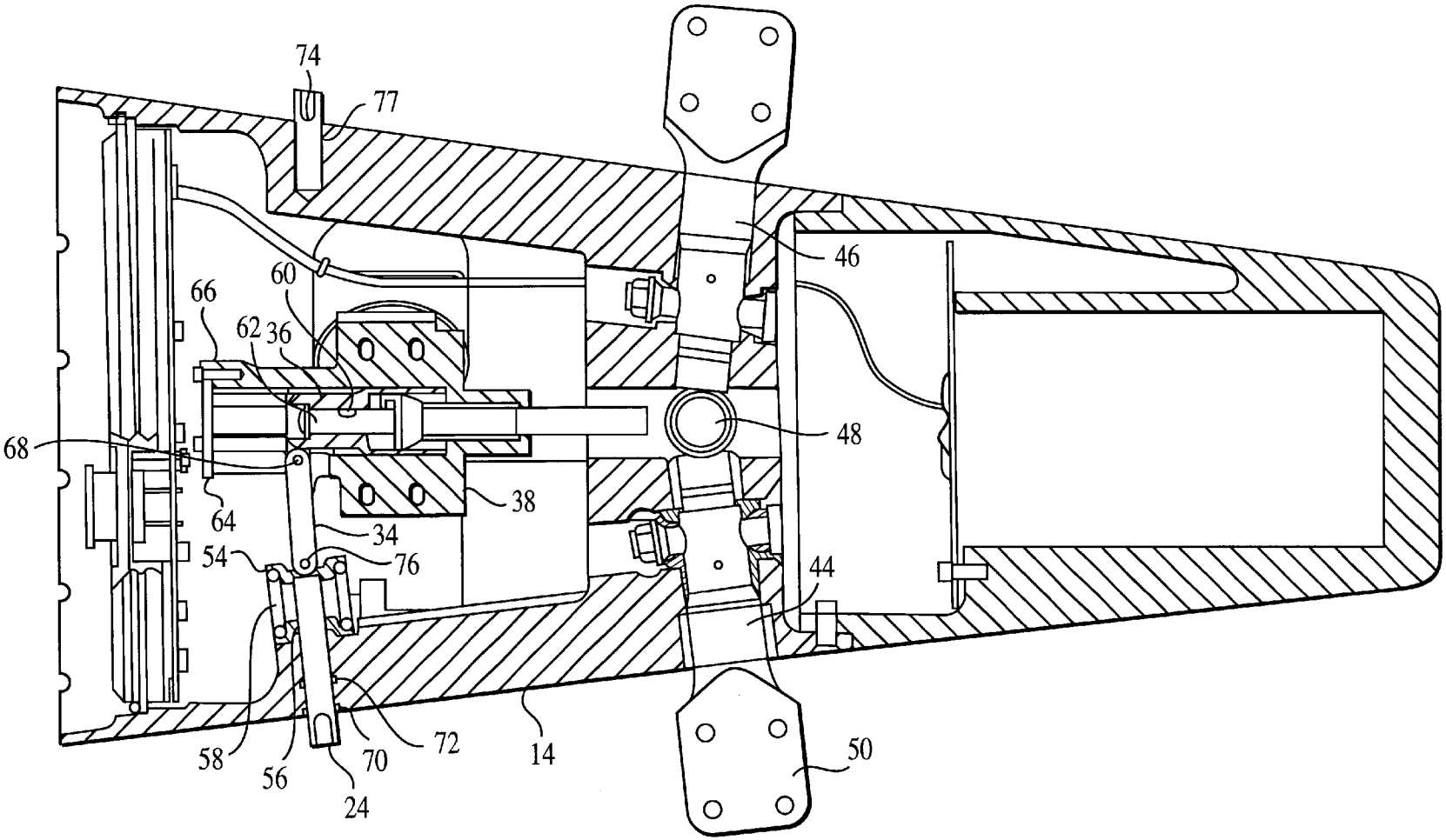
FIG. 4 is a partial cross-sectional view of the device of FIG. 2 taken about the lines 4—4 thereof.

As is shown particularly in FIG. 2, a plurality of locking pins (24,28,30 and 32), one for each of the fins (16–22) are adapted to extend outwardly away from the outer surface (14) of the missile (12) and into engagement with an opening (26) which is provided internally of the control fin (16). Through the utilization of the pin (24) and having it inserted into an opening such as shown at 26 the fin (16) is held rigidly in place Bath in its null position until such a time as the pin (24) is retracted from the opening (26). Similarly locking pins (28), (30) and (32) are shown engaging appropriate openings within the fins (18), (20) and (22). Each of the locking pins (24), (28), (30) and (32) is coupled by an appropriate link mechanism such as that shown at (34) to a slide member (36) which is disposed within a guide (38) for movement between a pin extend position as shown in FIGS. 2 and 4 and a pin retract position where the pins (24, 28, 30 and 32) are retracted from their respective openings in the fins (16–22). The slide member (36) is mounted within the guide (38) upon a plurality of balls (40), FIG. 3, which enables substantially friction free movement of the slide member (36) within the guide (38) between the extend and retract positions. An appropriate restraining member engages the slide assembly when it is in its pin extend position to prevent any inadvertent actuation of the system as a result of vibration loads or the like which would tend to cause the slide to move from its pin extend position as shown in FIGS. 2 and 3 to the pin retract position accidentally. A solenoid (42) is utilized to release the restraint on the slide assembly in response to an unlock command applied thereto from an appropriate controller operated by the aircraft pilot or autopilot preparatory to launch of the missile.

Referring now more particularly to FIG. 4 the structure as is illustrated in FIG. 2 and 3 is illustrated in greater detail. As is therein shown, fin shafts (44), (46) and (48) are connected to an appropriate drive train (not shown) which provides drive power to the fin shafts (44), (46) and (48) to rotate the shafts to provide appropriate directional control for the missile. The shafts (44), (46) and (48) terminate in fittings such as those shown at (50) and (52), respectively, to which fins such as those shown at (16), (18), (20) and (22) may be affixed. For purposes of ease of illustration and clarity of description the fins have been eliminated from FIG. 4. As is shown in FIG. 4 the link (34) is attached by way of a link pivot pin (76) to the locking pin (24). At the juncture between the link (34) and locking pin (24) there is provided a spring retainer (54) and also surrounding the pin (24) and adjacent the surface (14) is an additional spring retainer (56). Disposed between the spring retainers (54) and (56) is a spring (58) which as will be described more fully below is placed in compression when the slide member (36) is in its pin extend position as shown in FIG. 4. As is also illustrated the slide member (36) defines a bore (60) therein which receives a striker (62) which functions to initiate movement of the slide member (36) when the slide member is in its pin extend position as shown in FIG. 4. An appropriate stop mechanism (64) is disposed on the end (66) of the guide member (38) to stop the movement of the slide member (36) when it moves to its pin retract position.

As is also illustrated the link (34) is connected at the pivot (68) to the slide member (36). It is therefore seen that the link (34) couples the pin (24) to the slide member (36) thereby causing the pin (24) to reciprocate between its extended position and its retracted position as the slide moves between its pin extend position and pin retract position. It should also be noted that O-rings (70) and (72) may surround the pin (24) just beneath the surface (14) of the missile.

Under some circumstances a fin may be affixed to the missile but not used for control of the missile flight path but rather as a stabilizing fin. Under such circumstances, a pin such as that shown at (74) may extend outwardly through an opening provided in the surface (14) of the missile and may also have an O-ring (77) extending therearound. However, the pin (74) would not be retracted but would remain in the fixed position as shown in FIG. 4 at all times after assembly including after launch.

Figure 5:
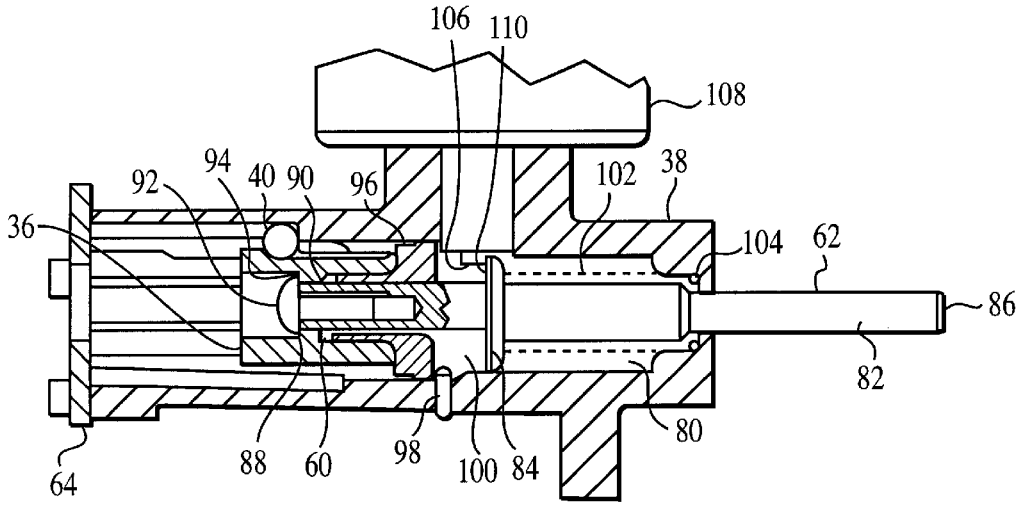
FIG. 5 is a partial cross-sectional view taken about the lines 5—5 of FIG. 3.
Figure 6:
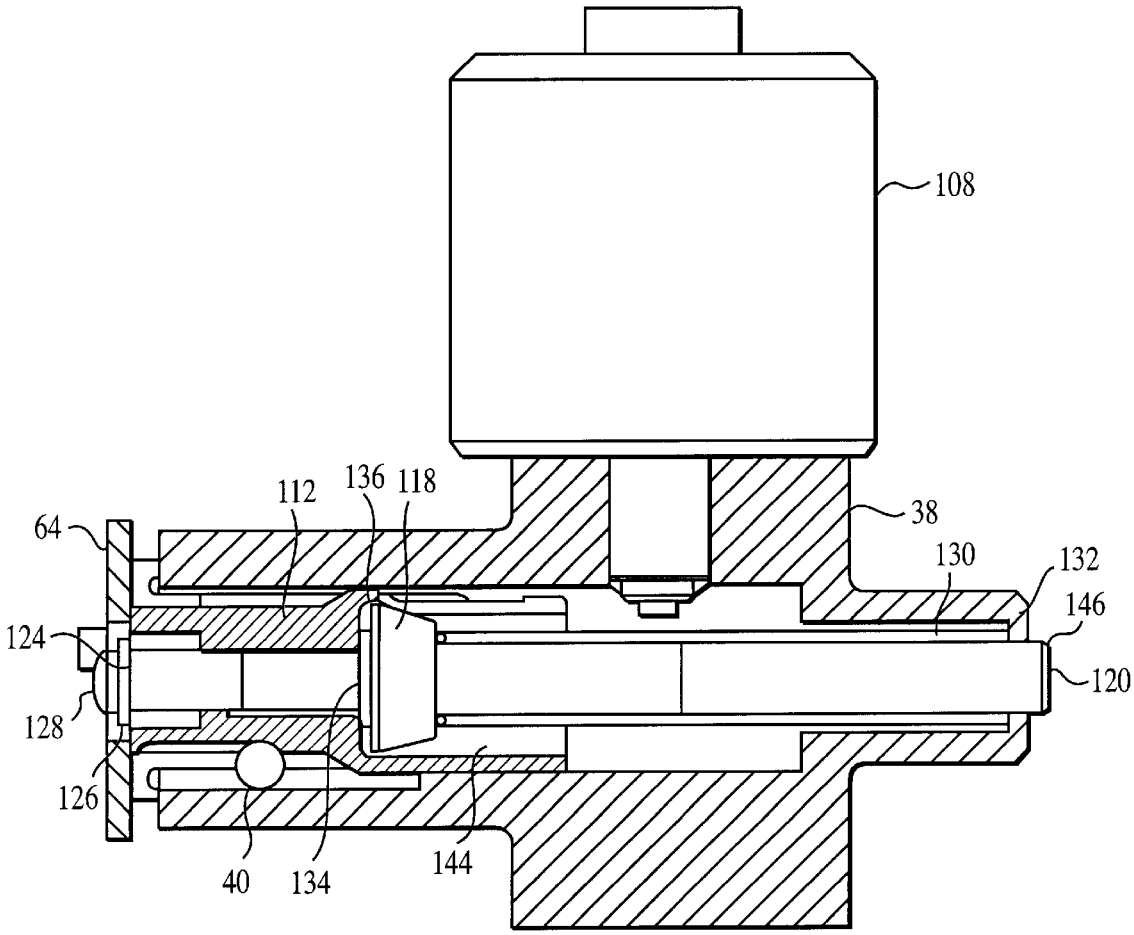
FIG. 6 is a partial cross-sectional view similar to FIG. 5 shown in the activated position.

By reference now to FIGS. 5 and 6, there is illustrated in greater detail the mechanical energy amplifier including a slide and a striker assembly disposed within a guide constructed in accordance with the principles of the present invention. In each instance, the striker assembly is adapted to be released upon an appropriate command from the control for the missile in such a manner as to propel the striker member or hammer having sufficient mass such that when it engages the slide member it will effect a positive initiation of movement of the slide assembly such that it will move the links (34) from their essentially dead center positions to a position so that the springs (58) surrounding the locking pins will effect a positive movement of the slide so as to retract the pins from their locking positions. A compression spring is utilized to move the striker assembly with a predetermined force into engagement with the slide assembly. By such engagement, the force of the striker is imparted to the slide assembly causing it to move. Upon the movement of the slide assembly the forces from the springs surrounding the pins are brought into play. This enables the utilization of a relatively light structure for the striker assembly while at the same time assuring that in all cases the locking pins shall be absolutely retracted from their locking positions. Those skilled in the art will recognize that the striker assembly and the spring activating, it may be designed to generate various forces as may be needed for a particular application. By way of example, however, when a striker having a weight of approximately 0.134 pounds is loaded with a spring having a preload force of approximately 10 pounds, the force applied to the slide assembly by the striker is 2045 times greater than the weight of the striker or 27.4 times greater than the spring preload force. Thus, it is seen that a surprising mechanical energy amplification is achieved by the structure of the present invention.

As shown in FIG. 5, the striker assembly (62) is disposed within the guide (38). The guide (38) defines a bore (80) within which the slide (36) is seated. The slide (36) as above indicated includes a bore (60) within which the striker assembly (62) is received for reciprocal movement. The striker assembly (62) includes a rod (82) having a hammer (84) disposed intermediate ends (86) and (88) thereof. The end (88) defines a bore (90) which is threaded and thread ably receives a screw (92), the head of which extends outwardly and engages a shoulder (94) formed by a protrusion extending radially inwardly from the bore (60). A collar (96) is received within the bore (60) and further defines an opening therethrough through which the rod (82) reciprocates. A stop (98) extends inwardly into a chamber (100) formed within the guide (38) to control movement of the slide assembly to the right as viewed in FIG. 5. A compression spring (102) is received between the hammer (84) and the wall (104) on the guide (38).

The structure as shown in FIG. 5 is in the pin extended position whereby the slide (36) has been positioned as shown in FIG. 4 so that the links (34) are in their essentially dead center positions and the compression spring (102) has been fully compressed. The pin (98) prevents movement of the slide assembly beyond the position shown. When the hammer (84) is in its loaded position (as shown in FIG. 4), a pin (106) extending from the solenoid (108) contacts the face (110) of the hammer thus, holding it in the position as illustrated in FIG. 5. Upon an appropriate command to the solenoid (108) the pin (106) is retracted allowing the spring (102) to immediately propel the rod (82) toward the left as viewed in FIG. 5 so that the face (110) of the hammer (84) strikes the collar (96) with sufficient momentary force to initiate movement of the slide (36) toward the left as viewed in FIG. 5. Immediately upon such movement occurring, the links (34) are moved off their dead center position and the springs (58) are brought into play and with the extreme force generated thereby, positively propels the slide (36) toward the left as viewed in FIG. 5 thereby retracting the pins (24) from the openings in the fins thus unlocking them for appropriate steering operation of the missile.

By reference now to FIG. 6, a structure similar to that illustrated in FIG. 5 is shown but with modifications to the slide and to the striker assembly. As is illustrated in FIG. 6, the slide assembly (112) is constructed from a single member which defines a bore (114) within which the striker assembly (116) is reciprocally received. The striker assembly (116) is formed similarly to that shown in FIG. 5 in that a hammer (118) is formed intermediate the ends (120) and (124) thereof. A flat washer (126) is received and held in place by a screw (128) which is thread ably received within the end (124) of the striker assembly (126). The washer (126) limits the travel of the striker (16) toward the right (FIG. 6) within the bore (14) provided in the slide (12). As above described, a compression spring (130) is seated against the hammer (118) and the wall (132) of the guide (38). The structure as illustrated in FIG. 6 is in the pin extract position in that the spring (130) is shown fully extended and the hammer (118) has moved towards the left causing the slide (112) to bottom out against the stop (64). The hammer (118) defines a face (134) which contacts a shoulder (136) formed by a reduced diameter portion of the bore (114).

In operation of a fin locking mechanism constructed in accordance with the principles of the present invention, the missile would be assembled with the fins in their locked position. That is, upon assembly of the missile the fins would be attached to the members (50) and (52) (FIG. 4) and would then be positioned such that the opening as shown for example at (26) (FIG. 2) would be immediately adjacent the opening in the surface (14) through which the pin (24) would extend. The slide (36) would then be pushed to its pin extend position as shown in FIG. 2 and 4, thus causing the pins for example at (24), (28), (30) and (32) to extend through the openings in the surface (14) and into the openings in the fins (16), (18), (20) and (22). The restraining mechanism (106) would then be engaged to assure that the slide member (36) remained in its pin extend position. It should be noted that when the slide (36) is moved through its pin extend position the links such as (34) are positioned in their close to dead center position thereby asserting no force on the slide member (36). It should also be noted that when the slide (36) is moved to its pin extend position, the springs (58) (FIG. 4) and (102) (FIG. 5) are placed in their fill compression position. In accordance with the principles of the present invention, the spring creating the most force is the spring (58) which would be used to positively assure that the slide (36) is moved to its pin extract position upon receipt of the appropriate command signal. However since the links such as that shown at (34) is in substantially dead center position merely removing the restraining force from the slide (3 6) will not necessarily cause it to commence to move to the pin extract position. However, the spring 102 is provided and as above described, when the restrain (106) is withdrawn by the solenoid 108, the hammer (84) strikes the slide (36) initiating its positive movement toward the pin retract position which moves the links (34) off their dead center position.

After assembly of the fins in their locked position as above described the missile (12) will be loaded upon the aircraft and the aircraft would take flight toward the predetermined area so that it may accomplish its mission. Upon detection of the desired target whether it be a surface target or an air target, depending upon the particular mission of the missile involved, and at the desired time of launch an appropriate control signal from the controller would be applied to the solenoid (42) (FIG. 2) releasing the restraining device from engagement with the slide member (36). When the unlock command is received and the solenoid is activated to release the restraint on the slide (36), the spring (102) (FIG. 5) will then propel the hammer into engagement with the slide causing it to move on the balls (40) towards the left as viewed in FIG. 4 and the links (34) are displaced from their dead center position. Immediately upon the links moving past the dead center position, the springs (58), which as above noted, generate the greatest amount of force are activated and move the links forcibly downward as viewed in FIGS. 2 and 3, thus, positively moving the slide (36) towards the left. Since all of the links are coupled to the slide, the links will be simultaneously moved thereby positively extracting the pins from the openings in the fins. In this condition the control signals received from the guidance system in the missile can appropriately move the shaft such as shown at (44), (46) and (48) to cause the fins to move appropriately to control the flight path of the missile.

There has thus been disclosed a locking mechanism for use on a missile to lock moveable control fins extending from the surface thereof in null positions to thereby eliminate the application of aerodynamic loads to the drive train of the missile and which includes a mechanical energy amplifier ensuring positive deactivation of the locking mechanism at the time a launch command signal is received.

What is claimed is:

1. A locking and unlocking mechanism for use on a missile having a plurality of movable control fins extending from an outer surface thereof, said mechanism comprising:

a locking pin for each movable control fin adapted to extend through said outer surface into an opening in said control fin to retain said control fin in a fixed position prior to said missile being activated;

a slide member movable between a pin extend and a pin retract position; a plurality of links, one for each locking pin, coupling each said pin to said slide member;

each of said links being positioned in substantially a dead center position when said slide member is in its pin extend position;

striker means for engaging said slide member with sufficient force for initiating movement of said slide member away from its pin extend position; and means for positively moving said slide member from its pin extend position to its pin retract position to positively remove each said pin from each said opening in its respective movable control fin.

2. A locking mechanism as defined in claim 1 which further includes means for releaseably securing said slide member in its pin extend position.

3. A locking and unlocking mechanism as defined in claim 2 wherein said striker means includes a hammer displaced from said slide member when said slide member is in its pin extend position.

4. A locking and unlocking mechanism as defined in claim 3 which further includes means for continuously urging said hammer toward said slide member.

5. A locking and unlocking mechanism as defined in claim 4 wherein said striker means includes a rod upon which said hammer is secured and said slide member defines a bore within which said rod is reciprocally disposed.

6. A locking mechanism as defined in claim 5 wherein said means for continuously urging comprises a first resiliently deformable member received within said bore.

7. A locking mechanism as defined in claim 1 which further includes a pivot pin at each end of each said link for pivotally attaching each said link between said slide member and a respective one of said locking pins.

* * * * *